United States Patent [19]

Mascherpa

[11] 4,150,758

[45] Apr. 24, 1979

[54] APPARATUS FOR STOWING AND CONVEYING ARTICLES, PARTICULARLY FOR USE IN PARKING MOTOR VEHICLES

[76] Inventor: Carlo Mascherpa, Corso Sempione 11, 20145 Milan, Italy

[21] Appl. No.: 745,599

[22] Filed: Nov. 29, 1976

[30] Foreign Application Priority Data

Dec. 1, 1975 [IT] Italy ..... 29863 A/75

[51] Int. Cl.[2] ..... B65G 106

[52] U.S. Cl. ..... 414/282; 198/610

[58] Field of Search ..... 214/16.1 B, 16.1 BA, 214/16.1 BB, 16.1 CB, 16.1 CE, 16.1 EA, 16.4 A, 16.4 C, 730; 74/422

[56] References Cited

U.S. PATENT DOCUMENTS

| | | | |
|---|---|---|---|
| 2,829,780 | 4/1958 | Boor | 214/16.1 BB |
| 2,842,972 | 7/1958 | Houdart | 74/422 |
| 3,283,924 | 11/1966 | Chasar | 214/730 |
| 3,561,620 | 2/1971 | Willis | 214/16.4 A |
| 3,833,140 | 9/1974 | Young et al. | 214/730 |

FOREIGN PATENT DOCUMENTS

| | | | |
|---|---|---|---|
| 1253162 | 10/1967 | Fed. Rep. of Germany | 214/16.4 C |
| 2263767 | 7/1974 | Fed. Rep. of Germany | 214/161.1 CD |
| 595435 | 12/1947 | United Kingdom | 214/16.1 BB |
| 1157071 | 7/1969 | United Kingdom | 214/16.4 A |

*Primary Examiner*—Lawrence J. Oresky

*Attorney, Agent, or Firm*—Stevens, Davis, Miller & Mosher

[57] ABSTRACT

An apparatus for stowing and conveying articles comprises at least one plurality of supporting and conveying units mutually interconnected at predetermined intervals, movable in continuously horizontal positions on an endless runway formed by fixed tracks for guiding the supporting members of said units, continuity of support by said tracks and by auxiliary fixed means associated therewith being provided for the supporting or conveying units through the whole runway, the means for interconnecting the units also serving to produce the control movements. In said apparatus are provided several pluralities of supporting units in side-by-side horizontal arrangement and in overlying vertical arrangement, the transfer of the individual loads from the supporting units of each plurality to the loading and unloading level and vice versa, being effected at the horizontal ends of the endless runway of the supporting units by transelevators, the transfer platform of which is apt to move both ways, in the direction in which said pluralities of supporting units are arranged side-by-side and in the vertical direction.

1 Claim, 25 Drawing Figures

APPARATUS FOR STOWING AND CONVEYING ARTICLES, PARTICULARLY FOR USE IN PARKING MOTOR VEHICLES

BACKGROUND OF THE INVENTION

The U.S.A. Pat. No. 3,405,795 of the same applicant relates to an apparatus for stowing and conveying articles, particularly for use in parking motor vehicles, comprising at least one plurality of supporting and conveying units mutually interconnected at predetermined intervals, movable in a continuously horizontal position on an endless runway formed by fixed tracks for guiding the supporting members of said units. The most important characteristics of this apparatus, ad claimed by said patent, are as follows:

continuity of support by said tracks and by auxiliary fixed means associated therewith is provided for the supporting and conveying units through the whole runway, the means for interconnecting the units also serving to produce the control movements;

said supporting units are constituted by carriages provided with wheels for their support on said tracks, said tracks comprising on each side of the carriages a pair of parallel horizontal lengths, common to the two wheels on the said side, and four pairs of inclined parallel lengths, which diverge outwardly substantially at the ends of the said horizontal lengths with equal and opposite inclinations, one for each wheel on the same side;

said fixed means associated with the tracks are constituted by pairs of wheels, mounted idle in the connection region of the upper horizontal track length with the two inclined lengths, and apt to support that carriage end which has left the track in the gap therein;

the means for interconnecting and moving the carriages are constituted by rotating chains, mounted offset on the tracks on one side and the other of the carriages, and each being connected to one of the two carriage axles;

The individual loads are transferred from the carriages to the loading and unloading level and viceversa by elevators situated within the endless runway of the supporting unit, said elevators being capable of vertically moving the supporting floors of the carriages with their load and, in the event that the apparatus should comprise various pluralities of concentric supporting units, of passing through the carriages without said floor provided in each plurality.

The apparatus described in U.S.A. Pat. No. 3,405,795 is essentially an apparatus contained in a reinforced concrete or metal cage, arranged below ground level, although the said patent specification explicitly provides also for its surface installation.

The practical construction of this apparatus and the increasing requirements of mechanisation and speed of operation in the field of goods storage and vehicle stowing , have led to further study and improve the apparatus itself.

In the course of these studies, substantial improvements have been obtained, which have enabled the apparatus for stowing and conveying articles, as heretofore defined, to be improved structurally and operationally, and to make its field of possible application much wider.

SUMMARY OF THE INVENTION

These improvements constitute the object of the present invention, which therefore relates to an apparatus for stowing and conveying articles of the type heretofore defined, comprising several pluralities of supporting units, in side-by-side horizontal arrangement and in overlying vertical arrangement, the transfer of the individual loads, from the supporting units of each plurality to the loading and unloading level and viceversa, being effected at the horizontal ends of the endless runway of the supporting units by transelevators, the transfer platform of which is apt to move both ways, in the direction in which said pluralities of supporting units are arranged side-by-side and in the vertical direction.

In an apparatus of this type, each transelevator comprises a tower structure, movable in the direction in which the pluralities of supporting units are arranged side-by-side, and a transfer platform, movable vertically in said tower, said transfer platform being in the form of a floor translating towards the pluralities of supporting units and in the opposite direction.

Alternatively, the transelevators may move relative to the pluralities of supporting units in other suitably chosen directions.

The present invention provides the specific application of the said apparatus, not only to the stowing and conveying of vehicles, particularly motor vehicles, but also to the stowing and handling of loads and goods of any kind, and in particular to the stowing and storing of containers, either on the ground, on boats or on the mooring docks for such boats.

BRIEF DESCRIPTION OF THE DRAWINGS

The invention is illustrated hereinafter in greater detail, by way of example, with reference to the accompanying drawings, in which.

DESCRIPTION OF THE PREFERRED EMBODIMENTS

Figure 1A:
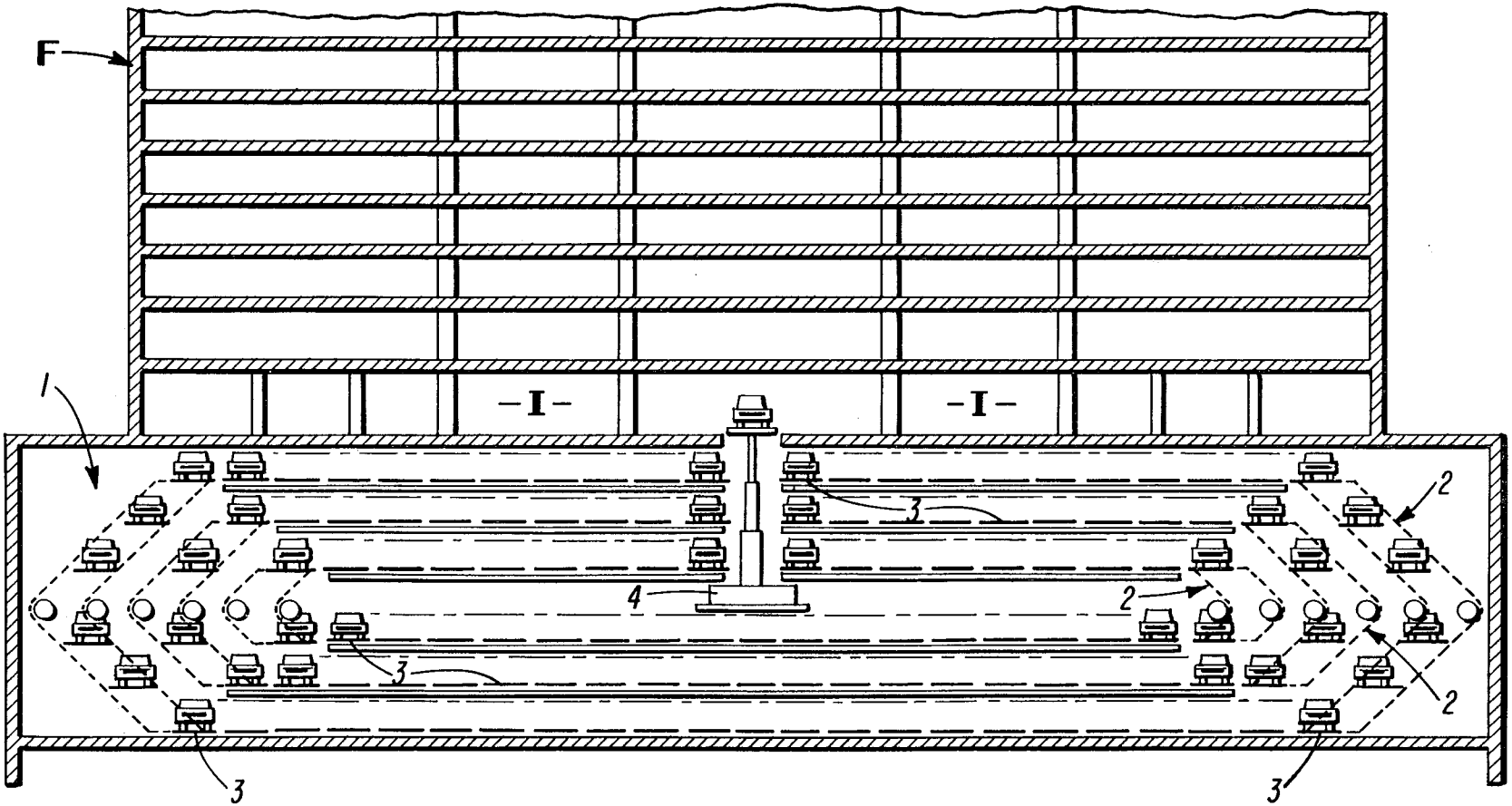
FIG. 1*a* is a side elevational section of one embodiment of the apparatus according to the invention.
Figure 1B:
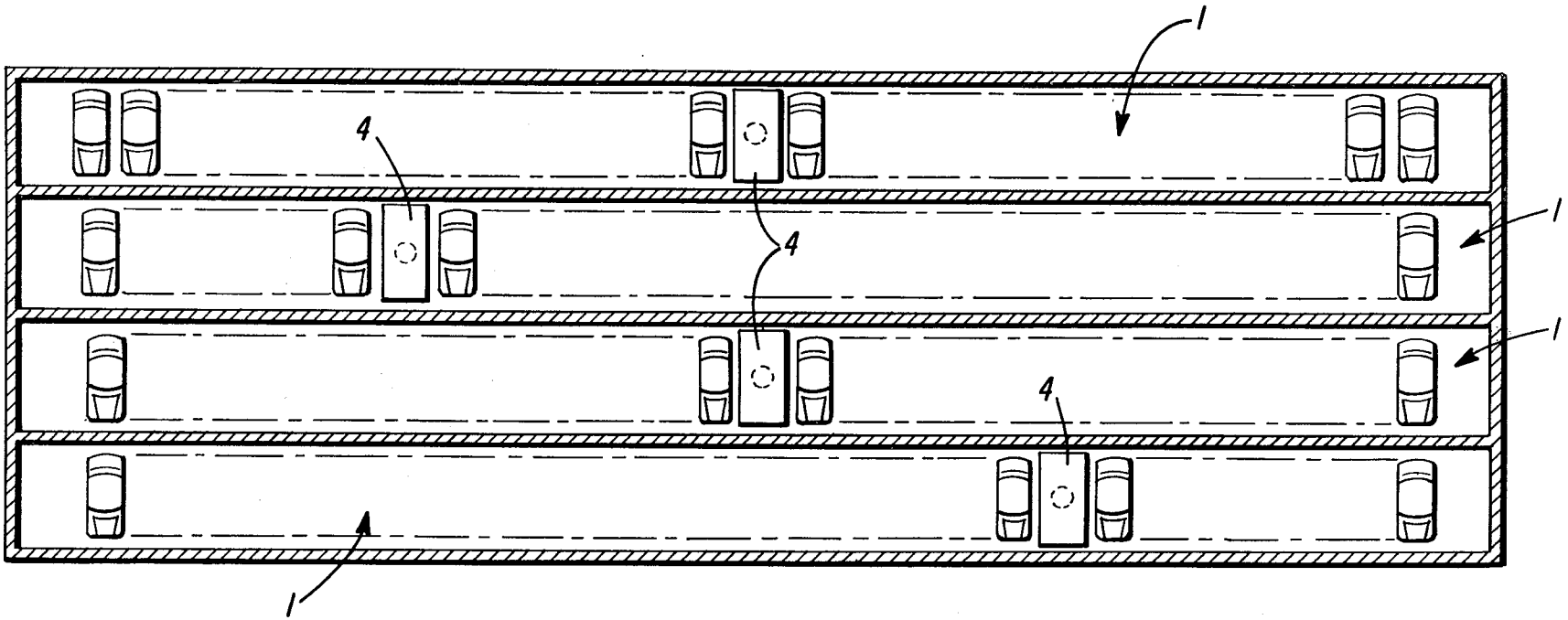
FIG. 1*b* is a plan sectional view of FIG. 1*a;*
Figure 1C:
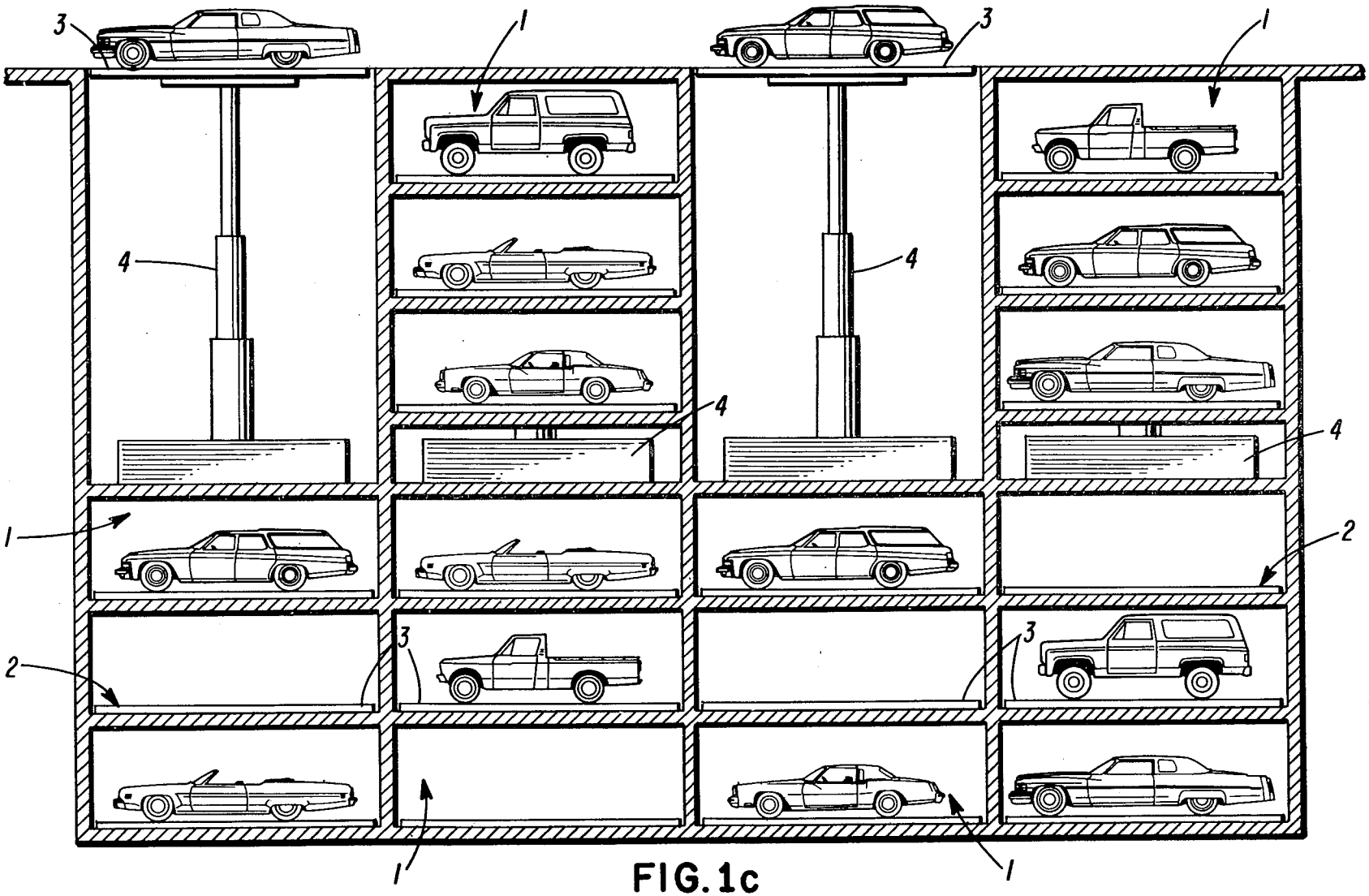
FIG. 1*c* is an end elevational view of FIG. 1*a;*

With reference to the drawings, FIG. 1 shows an apparatus according to the invention used as an underground garage for a large building F. The apparatus comprises four side-by-side assemblies 1 for stowing and conveying motor vehicles, in accordance with U.S.A. Pat. No. 3,405,795, each of these assemblies being formed by three concentric pluralities 2 of supporting units 3 mobile in an endless loop and continuously supported in a horizontal position. Each assembly 1 comprises an elevator 4, arranged at the centre of the most inner of the pluralities 2, for the odd assemblies of support units, and displaced towards one end or the other, for the even assemblies. In this manner, it is possible to stow a considerable number of motor vechicles underground, over the area of a building and, by playing upon the distribution of the entrances I to the building (the ground floor of which coincides with the loading and unloading level for the automobiles), a rapid and confortable access to the apparatus may also be obtained during rush hours.

Figure 2A:
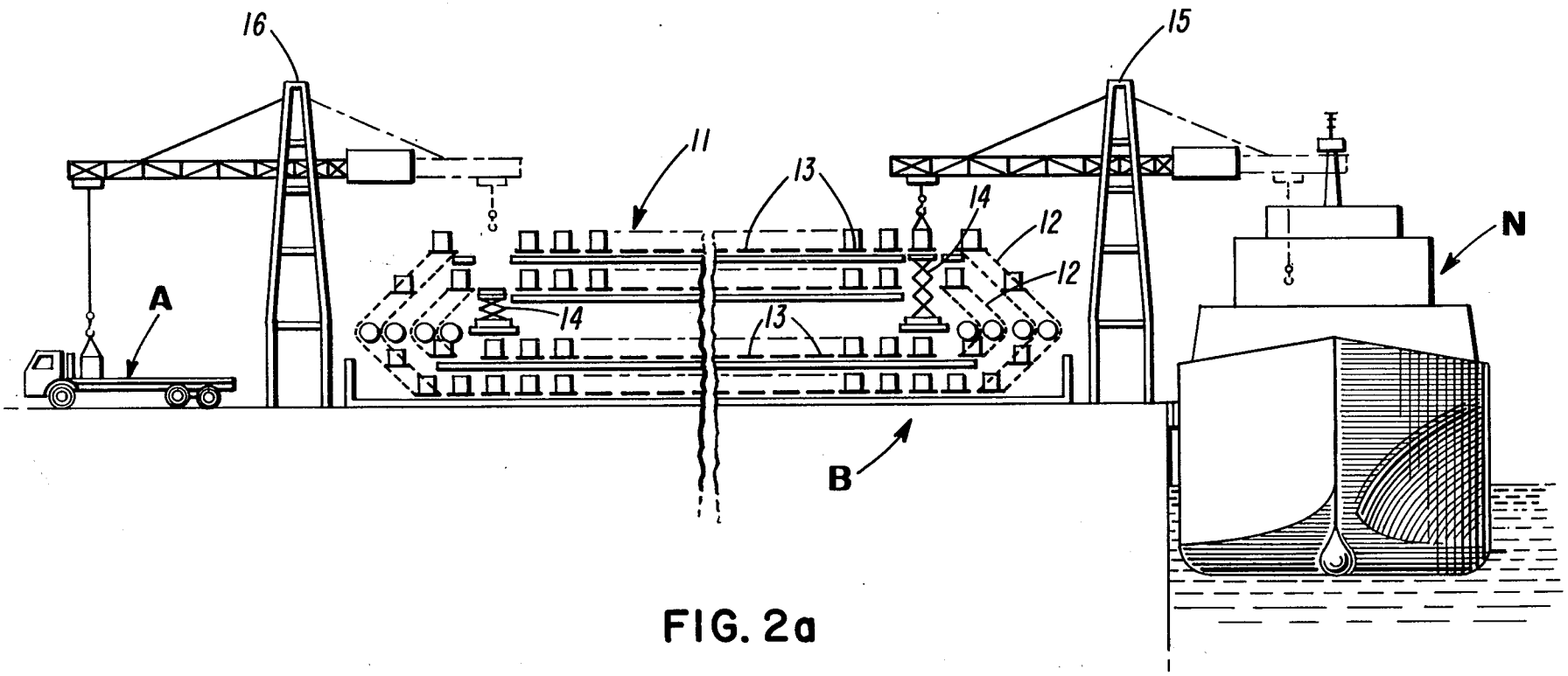
FIG. 2*a* is a side elevational section of one embodiment of the invention utilized at dockside.
Figure 2B:
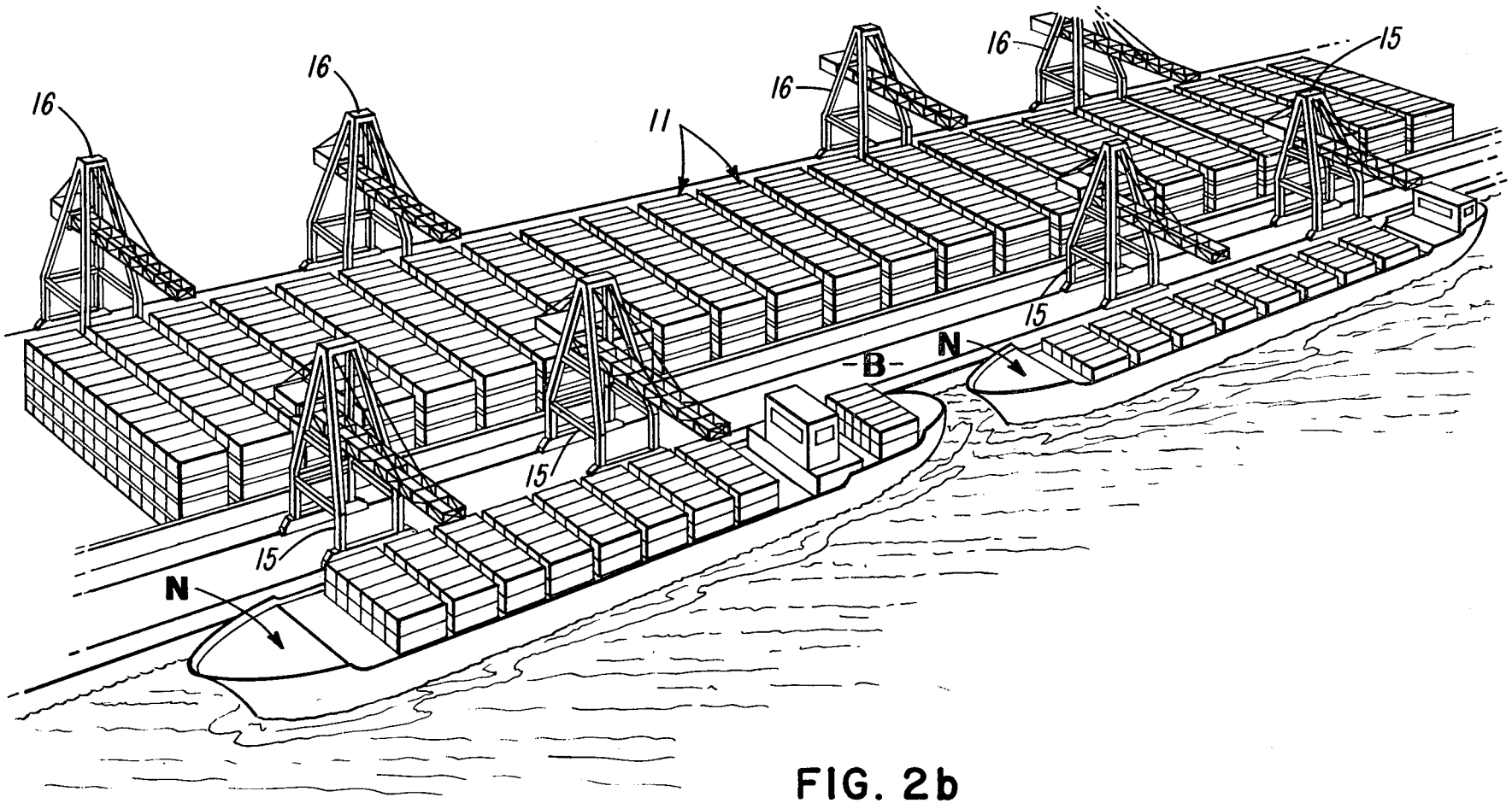
FIG. 2*b* is a perspective view of FIG. 2*a;*

FIG. 2 of the drawings relates to the stowing and conveying of goods held in containers on a port dock B. The apparatus according to the invention, which rises from the dock floor, is formed in this case by a multiplicity of assemblies 11 of pluralities 12 of supporting units 13, which are mobile along a closed circuit and are supported continuously in a horizontal position, each assembly 11 comprising two concentric pluralities 12 served by two end elevators 14. Special container cranes 15 and 16, adapted to serve cargo boats N and trucks A, for conveying the handled containers 17 by sea and land, cooperate with these elevators.

Figures 3A, 3B, 3C:
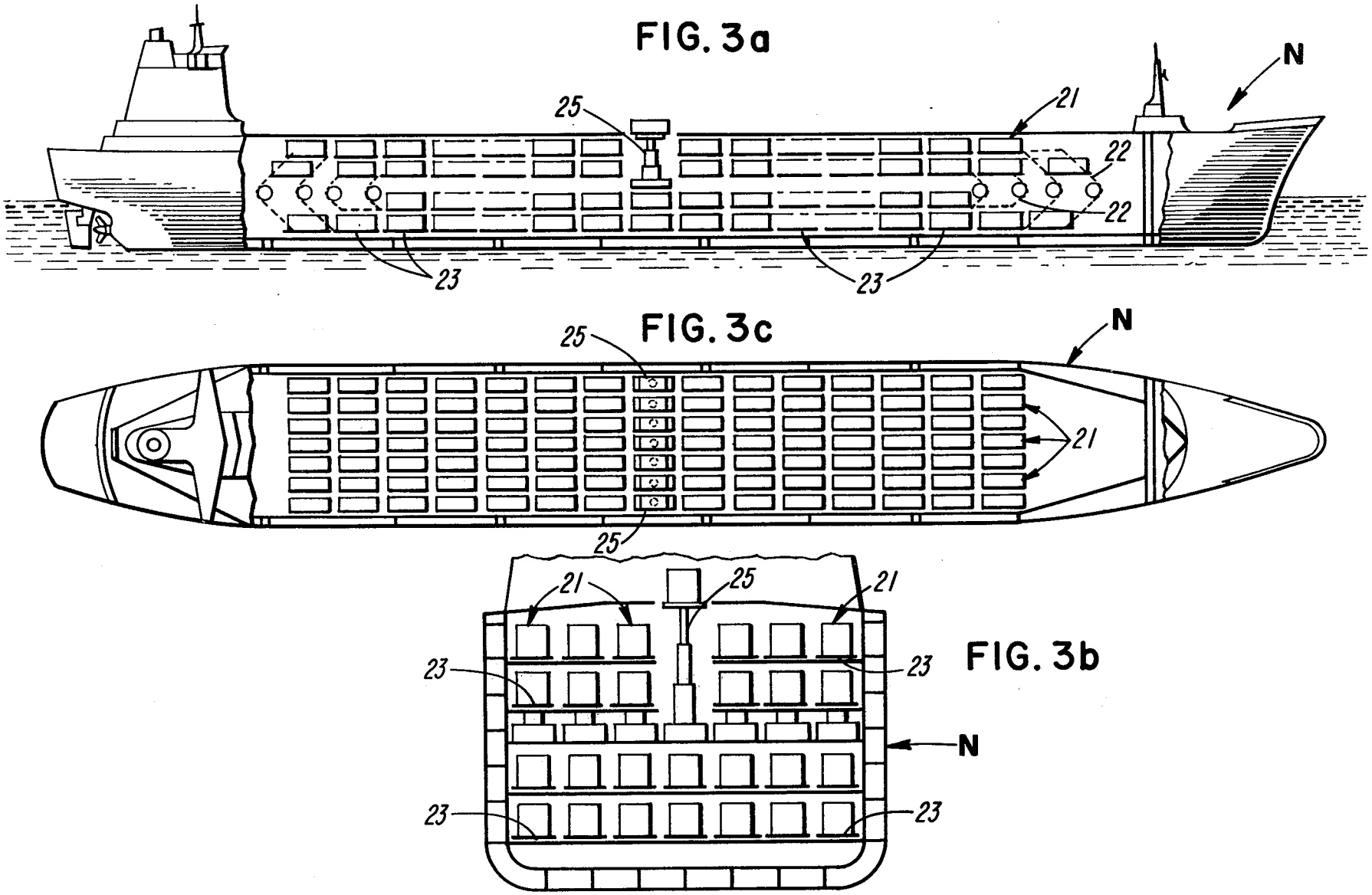
FIG. 3*a* is a side elevational section of a ship utilizing one embodiment of the present invention.
FIG. 3*b* is an end elevation of the ship of FIG. 3*a;*
FIG. 3*c* is a plan view of the ship of FIG. 3*a;*

The boats N may themselves house an apparatus according to the invention, as shown in FIG. 3, with obvious advantage for the loading and unloading of the goods.

FIG. 3 shows a diagrammatic representation of a boat N comprising internally an apparatus formed by seven assemblies 21, each with two concentric pluralities 22 of supporting units 23 for containers 24, a central elevator 25 being provided for each assembly 21.

Figure 4A:
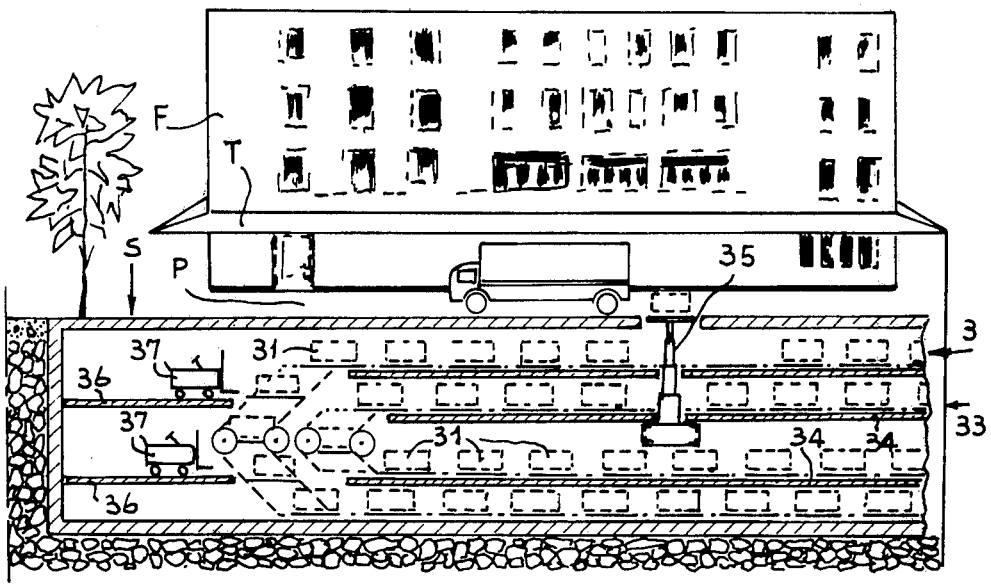
FIG. 4*a* is a side elevational section of the embodiment of the invention utilized in the storage and movement of goods.
Figure 4B:
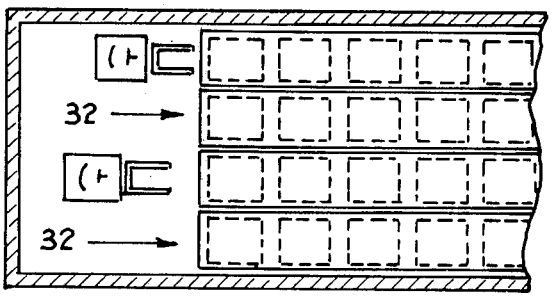
FIG. 4*b* is a plan sectional view of FIG. 4*a;*
Figure 4C:
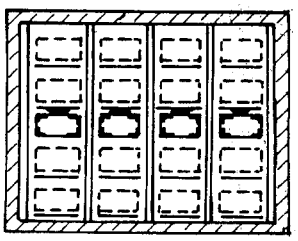
FIG. 4*c* is an end elevational section of FIG. 4*a;*

The improved apparatus of FIG. 4 is also provided for storing goods, in this case in the form of ordinary packing cases 31. The apparatus is housed in a basement S of a building F, the loading and unloading dock of the apparatus, situated under the projecting roof T of the building, coinciding with street level P. The apparatus according to the invention in this case comprises four assemblies 32 of two concentric pluralities 33 of supporting units 34, mobile along a closed circuit and continuously supported in a horizontal position. Each assembly is served by an elevator 35. The apparatus also comprises two loading and unloading docks 36 alternative to the dock P. These docks, which are connected to the interior of the building F, for example by goods elevators, are served by lift trucks 37. This application is particularly suitable for a department store or supermarket, as the goods may be stowed directly outside the halls of the department store. Thus, reception or withdrawal of the goods can be carried out by a single control, and the goods undergo no other handling. Moreover, the goods may remain on their own support in the apparatus, independently of the manoeuvres of the other supports.

Figure 5A:
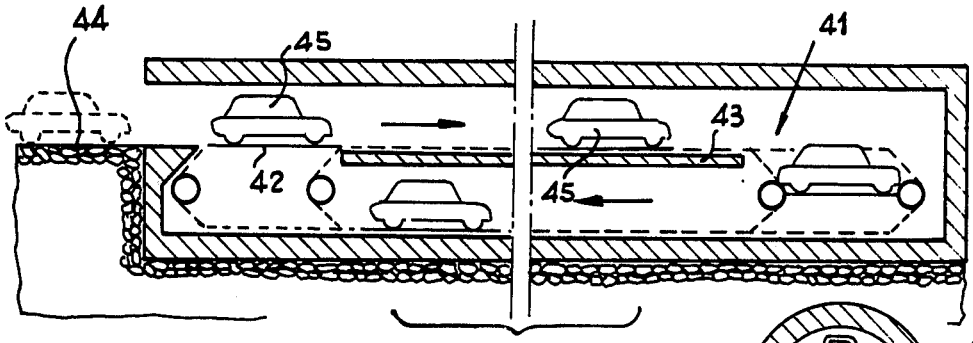
FIG. 5*a* is a side elevational section illustrating the invention when utilized for storing and moving automobiles.
Figure 5B:
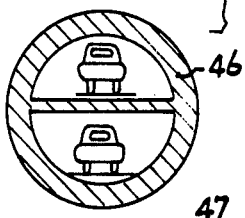
FIG. 5*b* is an end sectional view of FIG. 5*a;*
Figure 6A:
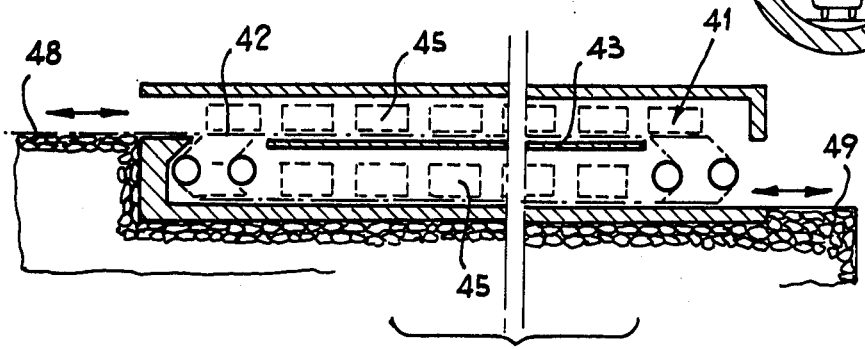
FIG. 6*a* is a side elevational section illustrating the invention when utilized for storing and moving goods.
Figure 6B:
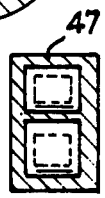
FIG. 6*b* is an end sectional view of FIG. 6*a;*
Figure 7A:
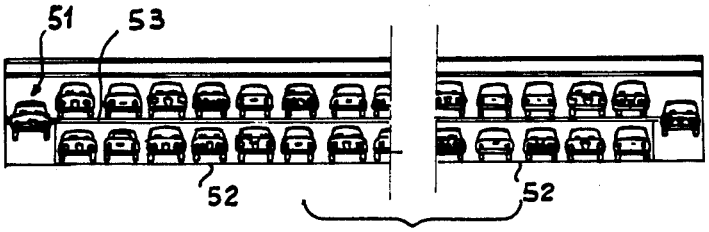
FIG. 7*a* is a side elevational view of the invention illustrating automobiles in the transverse position to their movement.
Figure 7B:
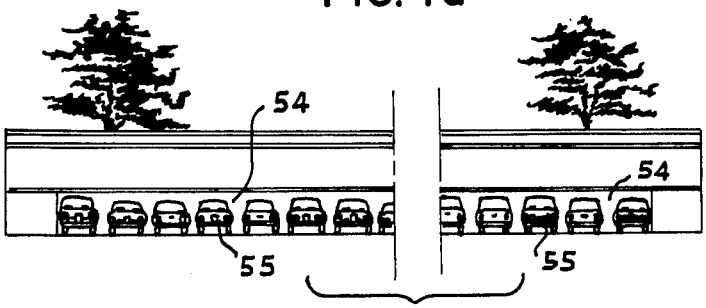
FIG. 7*b* is a side elevational view of the invention illustrating the possible simultaneous loading or unloading of a plurality of automobiles.

As stated, FIGS. 5, 6 and 7 illustrate three garages of limited size, which may be constructed with the apparatus according to the invention in an extremely simple and economical manner.

In FIG. 5, a single plurality 41 of supporting units 42 is used, its upper track 43 being at the level of the loading and unloading dock 44, to allow direct access by the driver without requiring other means for transferring the motor vehicles 45. The apparatus may be partially below ground level or it may take advantage of slight variations of level in the ground surrounding a building, as shown in FIG. 5, in which the cage 46 containing the apparatus is of tubular structure.

While in FIG. 5 the apparatus has only one loading and unloading dock, the apparatus shown in FIG. 6—which is identical to the previous apparatus, except for the parallelepiped form of the containing cage 49—comprises one loading and unloading dock at each end (48 and 49 respectively). It is mounted outside and requires a difference in level between said docks 48 and 49.

FIG. 7 shows a garage, which can be easily constructed by using prefabricated elements, and which is characterised by the possiblity of simultaneously delivering a large number of automobiles. A single plurality 51 of supporting units 52 is used and one of their tracks 53 is arranged at street level, onto which opens a very wide access bay 54. A large number of automobiles 55 may simultaneously travel to or from their supporting units by moving transversely to the main extension of the apparatus, instead of parallel to it, as in the example shown in FIGS. 5 and 6.

FIGS. 8 to 14 relate to a particularly complete and sophisticated embodiment of the apparatus according to the invention, designed to take account of the most modern requirements.

At the present time, the stowing, loading and unloading of motor vehicles, goods and materials, frequently have to take place in very different positions, according to service and handling requirements, and dependent on the volume, weight and position of their arrival at the stowing point and their destination for use, these different positions being dictated by reasons of speed and economy and to avoid increased use of personnel or auxiliary means for their transfer.

To this end, the most up-to-date technique uses increasingly automated mechanisation of movement, which also comprises complex electronically controlled systems. The apparatus according to the present invention, shown in FIGS. 8 to 14, utilises such a technique and satisfies all existing requirements very simply and economically. By its means, it is possible to send to its destination or receive an automobile or any other material or goods to be stowed, without the load ever being moved on to other tracks or ancillary means. The article to be stowed always travels on its own single track, independently of level differences and of the areas requested by service requirements, this being very important for operational speed and installation economy. The apparatus also comprises various entrance and exit systems of independent and simultaneous operation, leading to faster and more rational working, with smaller times and greater economy.

The entrance and exit systems may be provided vertically and horizontally. Entry may take place on one side and exit on the other side, or in another part, or even at different levels, without the use of further means. The entrances and exits may be provided below ground, at street level or in elevation. Finally, the tracks may be of any line or shape, and may be vertical, horizontal, elliptical, circular, stepped or of other more suitable forms, providing they produce a single closed circuit.

Figure 8:
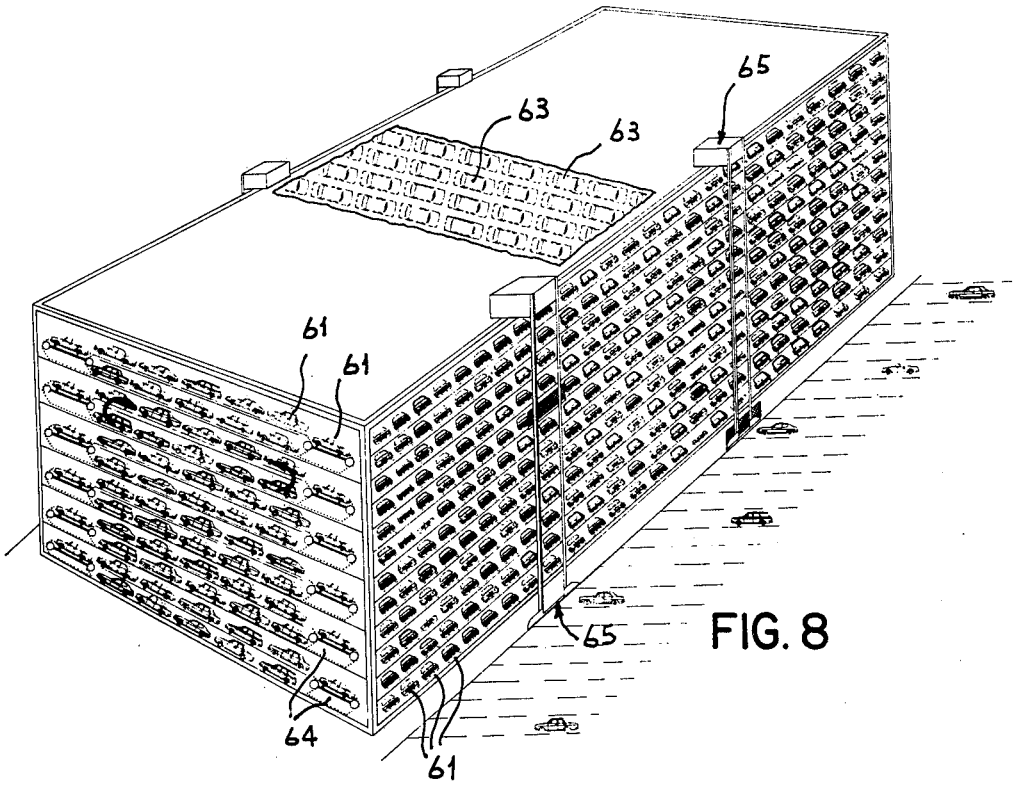
FIG. 8 is a perspective view of another embodiment of the invention as applied to loading for storage and unloading from storage automobiles.
Figure 9:
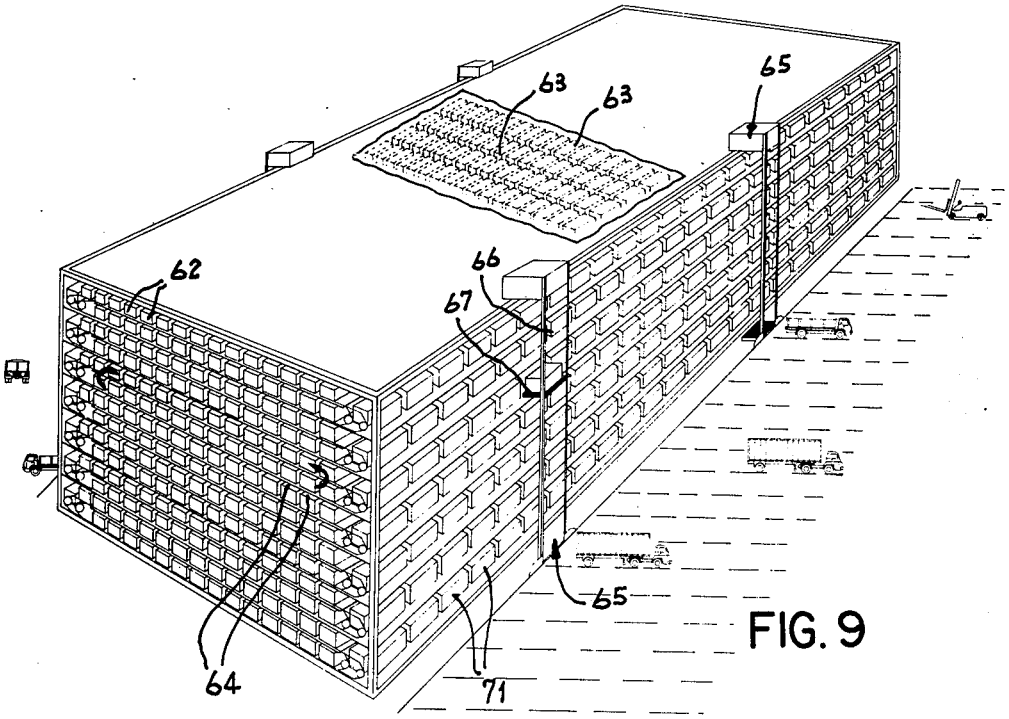
FIG. 9 is a perspective view of an embodiment of the invention as applied to loading and unloading goods.

On this basis, consideration will first be given to FIGS. 8 and 9. These relate to the same type of apparatus, but designed for two different purposes, namely, the stowing of atuomobiles 61 in FIG. 8 and the stowing of containers 62 (or packing cases of other types of goods of any kind) in FIG. 9. Both apparatuses comprise pluralities 63 of supporting units 64 in side-by-side and overlying relationship, which are mobile in a closed circuit and continuously supported in a horizontal position. The arrangement so obtained is in the form of rows and columns. This arrangement is served by various transelevators 65 (FIGS. 8 and 9 show four of these) which may be arranged on the sides of the apparatus facing the horizontal ends of the pluralities 63 of supporting units, as shown in the figures, but which could also be arranged to the side of said pluralities, on the other two sides of the apparatus, or into inner corridors formed in the apparatus parallel to said pluralities. It is also evident that the apparatus could comprise side-by-side blocks, such as those shown in FIGS. 8 and 9, separated by corridors traversed by transelevators.

In FIGS. 8 and 9, the apparatuses according to the invention rise from the loading and unloading dock, placed at ground level. There would obviously be no conceptual difference if they were constructed underground or partly underground.

The illustrated transelevators 65 are transfer devices, comprising a tower 66 apt to translate parallel to the side of the apparatus which it serves, and a transfer platform 67 mobile vertically. They are therefore able, with great operational flexibility, to transfer loads from the loading dock at ground level onto any plurality in the column of the apparatus which they face, or from any plurality of any column to the plurality of another column in the same row, if limited to the elementary movements of the platform 67 or tower 66 respectively. However it is clear that combined movements of the tower and platform enable any desired load transfer in the row and column arrangement of the apparatus, to be made with extreme ease, speed and operational flexbility.

Other types of transelevators may be used with advantage. For example, transelevators with their tower moving along paths other than the path parallel to the side of the apparatus served, and operating partly as a lift truck.

FIGS. 10 to 14 show in detail the characteristics of the transelevators purposely designed for the apparatus of FIG. 8 and similar apparatuses.

These figures show that a transelevator 65 comprises a tower structure 66, formed by two uprights arranged side-by-side and guided lowerly and upperly by rails 68, 69, this latter being a rack rail, and a platform structure 67, mobile vertically along the tower 66. The reference number 70 indicates an electric motor, which imparts the translation movements on the transelevator tower, while the reference numbers 71 and 72 indicate an electric motor and cable, which impart the vertical movement on the platform 67.

Figure 10:
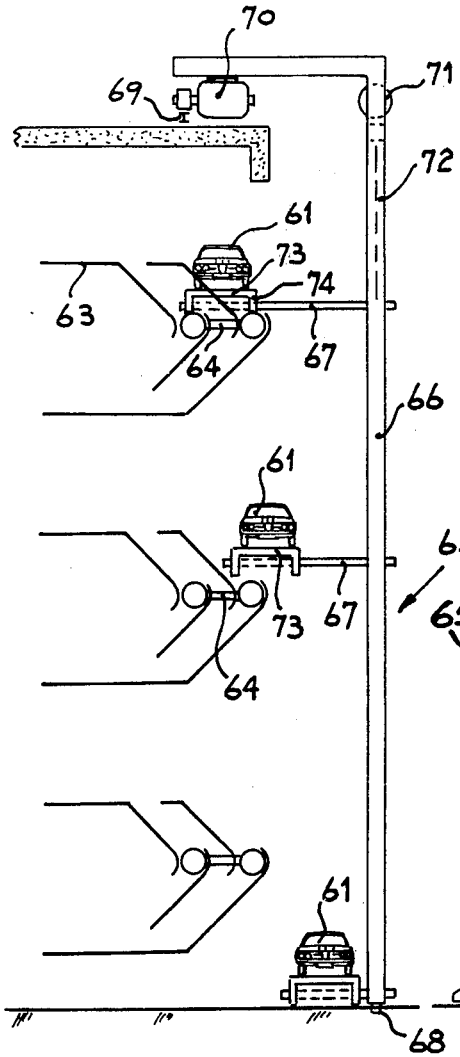
FIG. 10 is a side elevational view of an embodiment of the invention permitting the loading and unloading of automobiles outside of the storage area.
Figure 11:
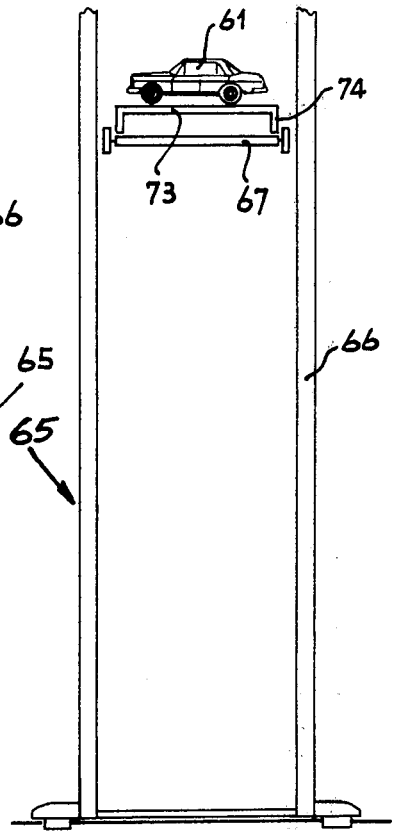
FIG. 11 is an end elevational view of FIG. 10.

FIGS. 10 and 11 are very diagrammatic and show how it is possible to take an automobile 61 at ground level, by means of the platform 67, raise it to the level of the plurality 63 of supporting units 64, as the platform itself moves progressively towards the overlying pluralities in the apparatus, and deposit it on a supporting unit 64 in an end position. As can be seen from these same figures, transfer is effected with the aid of a square or rectangular loading plate 73, provided with four feet 74 at its corners, so that it is possible for the transfer platform 67 to be inserted from all sides under the plate, between said feet, for its movement.

Figure 12A:
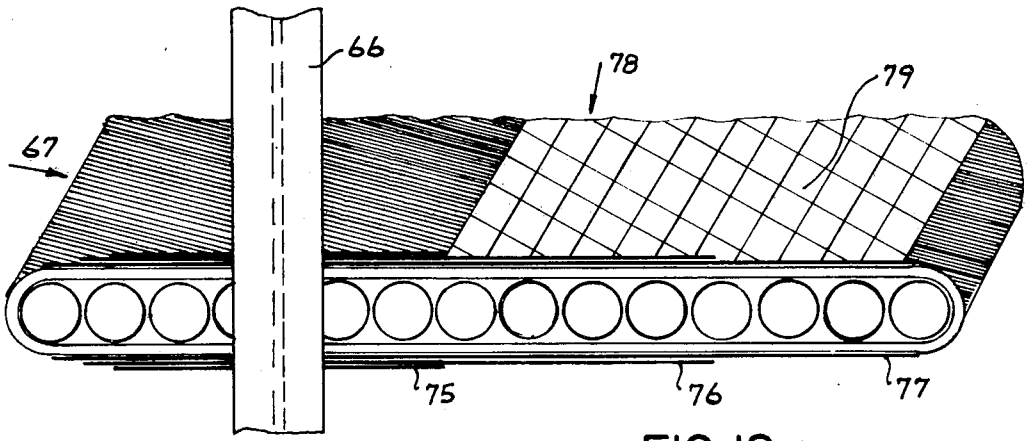
FIG. 12*a* is a perspective view of the transfer platform of the invention to the right of the tower uprights.
Figure 12B:
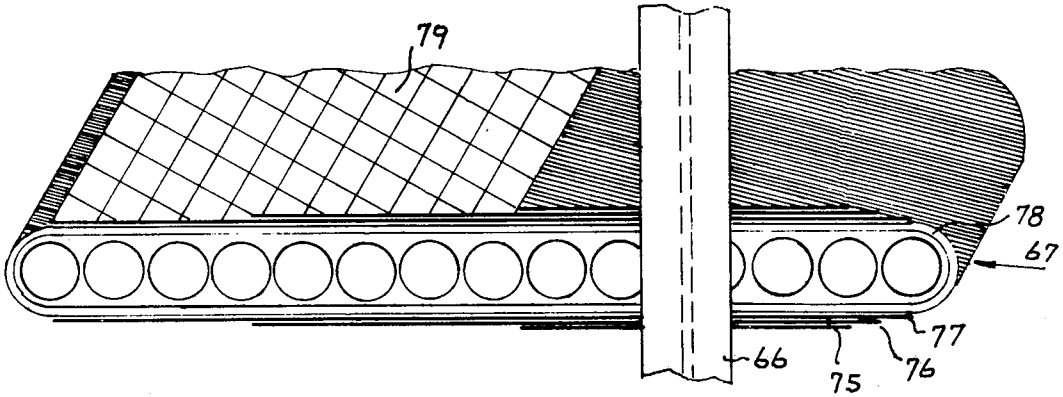
FIG. 12*b* is a perspective view of the transfer plaform of the invention to the left of the tower uprights.
Figure 13:
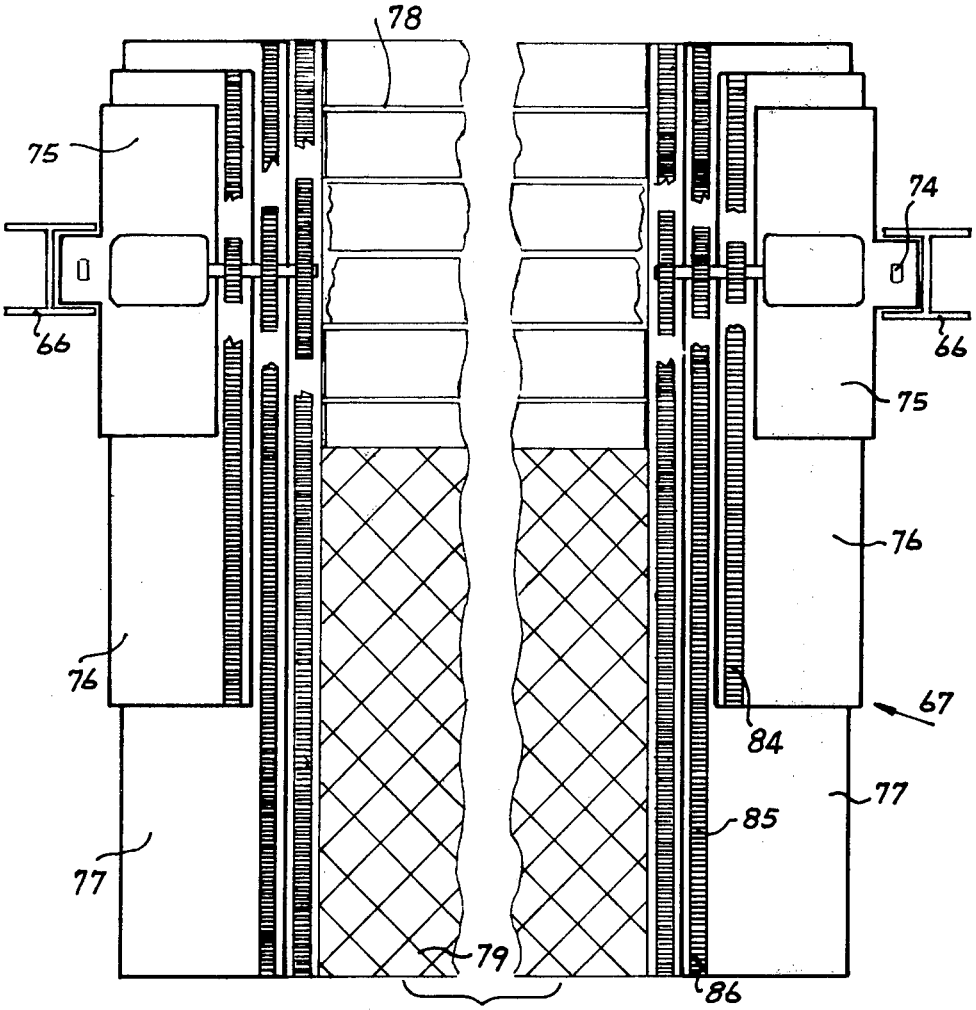
FIG. 13 is a plan view of the platform of FIG. 12*b;*.
Figure 14:
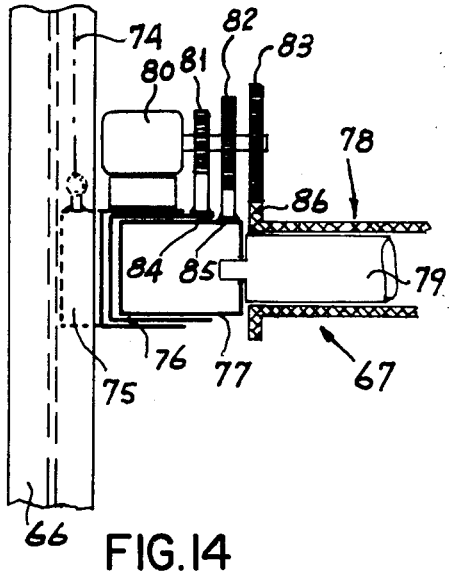
FIG. 14 is a detailed end elevational section of a portion of the tower and platform of the invention.

FIGS. 12 to 14 are detailed views, illustrating the transfer platform 67 constituted of a device in the form of a loading floor subject to translational movement. This device comprises: substantially rectangular metal half-box members 75, for load bearing purposes, supported close to the uprights of the tower 66 on which they slide, by metal cables 72 which provide their vertical movement; second rectangular half-box members 76, slidably mounted in the half-box members 75; a pair of rectangular box members 77, slidably mounted in the half-box members 76; and a roller carpet structure 78, the rollers 79 of which are idly mounted on the two box members 77. The roller carpet structure comprises a reinforced region 79 on the carpet, acting as loading floor. The device also comprises a reduction motor 80, with three gearwheels 81, 82, 83 keyed on to its shaft and engaged with the racks 84, 85, 86, provided respectively on the half-box members 76, on the box members 77 and on the edges of the carpet 78. It is apparent that, when the reduction motor 80 rotates, the half-box members 76, the box members 77 and the carpet 78 move at different speeds, to cause the horizontal movement of the entire transfer platform 67 in respect of the uprights of the tower 66. The speeds are adjusted in such a manner that the region 79 of the carpet 78, acting as loading floor for the loading plates 73, moves from one end position to the other while the same occurs for the entire platform, as is clear from FIG. 12 which illustrates these positions. By means of this system, all the elements of the moving floor platform are moved together by a single motor, without the need for gears and/or transmissions between the elements.

The same transelevators may be used for the apparatus of FIG. 9, with the difference that during the loading and unloading at street level, the containers or other cases are placed on the loading plates 73, or withdrawn therefrom, by cranes or lift trucks, while the automobiles to be stowed in the apparatus of FIG. 8, are usually arranged on or taken from said plates directly by the driver.

It is understood that the apparatuses described and illustrated are given by mere way of example, and that many other modifications thereof could be provided without departing from the scope of the invention. Thus, the transelevators associated with the apparatus could be of different form and characteristics from those shown in the accompanying drawings or briefly described. For example, they could be provided with an operating cab for an operator, in the event of having to carry out, for special reasons, all or some of the loading and unloading operations non-automatically. Also the arrangement of the various pluralities of supporting units forming the apparatus, may be different from the very simple type of arrangement illustrated, to enable it to be adapted to the requirements of use, to the site on which the installation is constructed or to the special requirements or intentions of the apparatus. Several assemblies of pluralities of supporting units may be grouped or combined, and some assemblies or some pluralities of supporting units may be different from others, especially with regard to their configuration and extension.

The equipment for stowing and conveying articles according to the present invention provides important advantages, and considerable problems in the field of stowing and handling articles are solved, with particular reference to the case in which these articles are automobiles (and more generally motor vehicles) and containers (or more generally cases of large size). These advantages are mainly:

the provision of apparatuses apt to form simultaneously a conveyor, a mobile store, a garage;

the construction of apparatuses with an access and withdrawal system which may be multiple, with the simultaneous operation of different lines;

access and withdrawal in said system may take place on the same side, or on different sides and at different levels, with the possibility of interchange;

the installation lines arranged side-by-side may alternatively be insulated to obtain controlled temperatures therein;

the apparatuses may operate and have entrances and exits underground, at street level or in elevation. They may also be used on vehicles and especially on boats;

there is always great facility, speed and simplicity of access and withdrawal of the articles, even in the case of stowing very large quantities of articles, providing one chooses the most suitable solution out of the many solutions supplied by the present invention.

I claim:

1. An apparatus for stowing and conveying articles comprising at least one plurality of supporting and conveying units mutually interconnected at predetermined intervals, movable in continuously horizontal positions on an endless runway formed by fixed tracks for guiding the supporting members of said units, continuity of support by said tracks and by auxiliary fixed means associated therewith being provided for the supporting and conveying units through the whole runway, the means for interconnecting the units also serving to produce the control movements, said apparatus being characterized in that it comprises pluralities of supporting units in side-by-side horizontal arrangement and in overlying vertical arrangement, the transfer of the individual loads from the supporting units of each plurality to the loading and unloading level and viceversa, being effected at the horizontal ends of the endless runway of the supporting units by transelevators, each said transelevator comprising an upright containing tower structure carrying cables running along the uprights and an electric reduction motor which drives said cables, said transelevator movable along the direction in which the pluralities of supporting units are arranged side by side, and a transfer platform movable vertically by said cables and motor and simultaneously reciprocally from one side of said tower structure to the other side of said tower structure in the direction in which said pluralities of supporting units are arranged side-by-side and in the vertical direction, said platform comprising a roller carpet, the rollers of which are mounted idle on a pair of lateral box members; a pair of half-box members, in which said box members may slide and which are in turn movable in respect of a pair of half-box members, fixed to the uprights of the tower structure of the transelevator; a reduction motor with a shaft provided with gear wheels; and racks carried by said box members, by said first half-box members and by said carpet, to provide controlled movements of the platform translating parallel to itself, without the need for gears and/or transmission between various platform elements, said roller carpet comprising a reinforced region acting as a loading floor, and wherein the loads are carried on said floor by loading plates provided with feet.

* * * * *